United States Patent [19]

Jacobs, Jr.

[11] 4,125,819

[45] Nov. 14, 1978

[54] ELECTRIC FUSE WITH EQUALIZED FILLER DUTY

[75] Inventor: Philip C. Jacobs, Jr., Newtonville, Mass.

[73] Assignee: Gould Inc., Rolling Meadows, Ill.

[21] Appl. No.: 825,980

[22] Filed: Aug. 19, 1977

[51] Int. Cl.[2] ..... H01H 85/08; H01H 85/12

[52] U.S. Cl. ..... 337/293; 337/161; 337/295

[58] Field of Search ..... 337/293, 159, 161, 162, 337/295

[56] References Cited

U.S. PATENT DOCUMENTS 3,394,333 7/1968 Jacobs, Jr. ..... 337/293

*Primary Examiner*—Harold Broome

*Attorney, Agent, or Firm*—Erwin Salzer

[57] ABSTRACT

An electric fuse having a tubular casing, an arc-quenching filler, a pair of terminal plugs closing the ends of the casing and fusible elements conductively interconnecting said pair of terminal plugs. The thermal duty imposed upon said arc-quenching filler is equalized so that equal amounts of filler are caused to absorb approximately equal amounts of heat. This is achieved by immobilizing the positions of the fusible elements and by giving them such a shape that heat dissipation is substantially equalized. In other words, the position of the fusible elements relative to the casing must be in such a way that they are not displaced when the fuse is filled with pulverulent arc-quenching filler, and the arc path of one of the fusible elements must be separated as much as possible from the arc path of the other fusible element.

4 Claims, 2 Drawing Figures

ELECTRIC FUSE WITH EQUALIZED FILLER DUTY

BACKGROUND OF THE INVENTION

It has been found when evaluating the performance of current-limiting fuses that the performance of identical specimens under identical testing conditions varies within a relatively wide range. Radiographs taken of such fuses after blowing thereof revealed the reasons for the difference in performance. To be more specific, whether the fulgurite is closer to the inner surface of the casing, or is closer to the longitudinal axis thereof, has a great influence on the performance of the fuse and the radiographs of blown fuses revealed, that significant changes as to position of the fusible elements, or as to position of the fulgurites resulting therefrom, had occurred. Another reason for observed differences in performance of identical specimens under identical testing conditions lies in the fact that different amounts of arc-quenching filler are associated with the same increments of the fusible elements or, to say it in another way, that the fuse metal is not sufficiently equally distributed in the pulverulent arc-quenching filler.

It is, therefore, the prime object of the present invention to provide current-limiting fuses that are not subject to the above limitations.

SUMMARY OF THE INVENTION

In fuses embodying this invention each of the terminal plugs closing the ends of the casing has a straight groove across the axially inner end surface thereof. The grooves in both end surfaces are situated in a common plane. A pair of fusible elements have their ends in said groove. The fusible elements have intermediate zones where they extend in parallel direction and are arranged in a common plane. Finally the fusible elements have center regions where they are bent in opposite directions. Two pairs of plates of electric insulating material are arranged immediately adjacent said pair of terminal plugs, each of which sandwiches said zones where said fusible elements are parallel and co-planar. This effects a maximal dimensional stability of the fusible elements coupled with a sufficiently constant ratio of fuse metal and pulverulent filler.

DESCRIPTION OF PREFERRED EMBODIMENT

Figure 2:
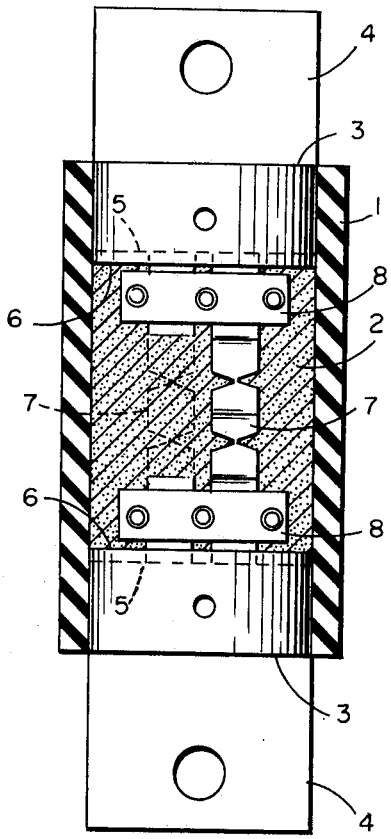
FIG. 2 shows the fuse of FIG. 1 as seen in the direction of the arrow R of FIG. 1 partly in side elevation and partly in longitudinal section.
Figure 1:
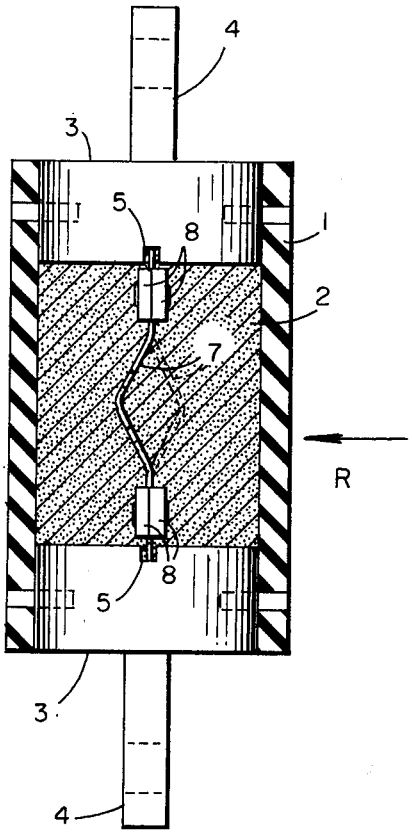
FIG. 1 shows a fuse embodying this invention partly in side elevation and partly in longitudinal section.

In the drawings numeral 1 has been applied to indicate a tubular casing of electric insulating material, e.g. glass-cloth-melamine. Casing 1 is filled with a pulverulent arc-quenching filler 2 such as, for instance, quartz sand. A pair of terminal plugs 3 provided with blade contacts 4 close the ends of casing 1. Each of terminal plugs 3 has a groove 5 across the axially inner end surface 6 thereof. A pair of fusible elements 7 conductively interconnects terminal plugs 3. The axially outer ends of fusible elements 7 are arranged in grooves 5 and conductively connected to terminal plugs 3 by solder joints (not shown). Fusible elements 7 have upper and lower zones where said pair of fusible elements are parallel and co-planar and each of said fusible elements 7 has a center region where said fusible elements 7 are bent in opposite directions. In other words, the center portion of one fusible element 7 is bent forwardly and the center portion of the other fusible element 7 is bent backwardly from the common intermediate plane of the fusible elements. The co-planar portions of fusible elements 7 are out of registry in a direction longitudinally of grooves 5. Reference numeral 8 has been applied to indicate two pairs of plates of electric insulating material each arranged immediately adjacent one of said pair of terminal plugs 3. Each pair of plates 8 sandwiches said intermediate zones of said fusible elements where said pair of fusible elements are parallel and arranged in the same plane.

Plates 8 have a length that is close to the diameter of plugs 3. As a result of the above configuration the fulgurites resulting from blowing of the fuse have a predetermined fixed position relative to the wall of casing 1 of the fuse and relative to the longitudinal axis thereof. The convex shape of one fusible element 7 and the concave shape of the other fusible element 7 coupled with their deregistration further contribute to the approximate equalization of each unit of volume of the arc-quenching filler 2 to a unit of arc-quenching duty.

It will further be apparent that the cross-sectional area of fusible elements 7 varies periodically from points having a maximal cross-sectional area to points having a minimal cross-sectional area. The center of the fusible elements 7 is a point of maximal cross-sectional area. This causes the establishment of series multibreaks on blowing of the fuse which is conducive to the current-limiting action of the fuse which is predicted on the rapid rise of the arc voltage.

The closest prior art is U.S. Pat. No. 3,394,333 to P. C. Jacobs, Jr., July 23, 1968. The present invention has the advantages claimed for the above prior art fuse, but the latter lacks the advantages of the present fuse. The structure of the present patent differs from that of the above patent in that the ends of several parallel connected fusible elements are inserted into the same groove of the terminal plugs, while in the above patent a separate groove is provided for the ends of each fusible element. The structure of the present invention differs from that of the above patent in that the insulating plates are arranged at the axially outer co-planar regions of the fusible elements, and tie together pairs of fusible elements, while in the structure of the above patent each fusible element has its own insulating plates which do not exert any tie-together or positioning action. Finally the structure of the present patent differs from that described in the above patent in that the fusible elements are arranged in different planes, i.e. are out of registry in a direction longitudinally of grooves 5, while in the structure of the above patent the fusible elements are arranged in the same plane. In other words, in the present structure the fusible elements are displaced in the direction of grooves 5 which receive the ends of the fusible elements, and this displacement is an important factor in equalizing the thermal duty to which the pulverulent arc-quenching filler is subjected. It will be apparent from the above that both grooves 5 are co-planar, and arranged in the planes of the axially inner end surfaces 6 of terminal plugs 7. It will further be apparent from the above that the pair of fusible elements 7 is connected in parallel and arranged out of registry in a direction longitudinally of the pair of grooves 5, and that the cross-sectional area of fusible elements 7 varies periodically between a predetermined maximum value at the centers of the fusible elements 7, and at the ends thereof, and a predetermined minimum value at two points of fusible elements 7 intermediate their three above referred-to points of maximum value. Fusible elements 7 include four co-planar portions which are its axially outer portions. Its axially inner portions are bent in opposite directions.

I claim as my invention:

1. A current-limiting fuse including (a) a tubular casing of electric insulating material;

(b) a pulverulent arc-quenching filler inside said casing;

(c) a pair of terminal plugs closing the ends of said casing, said pair of terminal plugs having grooves arranged in the same plane across the axially inner end surfaces thereof;

(d) a pair of fusible elements connected in parallel, having their ends in said grooves, each of said pair of fusible elements having a center region bent in opposite directions and each of said pair of fusible elements having axially outer regions which are straight, arranged in the plane defined by said grooves and displaced in a direction longitudinally of said grooves; and (e) two pairs of plates of electric insulating material each arranged immediately adjacent said axially inner end surfaces of said pair of terminal plugs and each sandwiching said axially outer regions of said pair of fusible elements which are straight; and said pair of plates firmly positioning said pair of fusible elements relative to said casing and relative to the axis thereof.

2. An electric fuse as specified in claim 1 wherein each of said two pairs of plates are connected by three fasteners of which one is arranged between said pair of fusible elements and two are arranged radially outwardly from said pair of fusible elements.

3. An electric current-limiting fuse comprising a tubular casing of electric insulating material, a pulverulent arc-quenching filler inside said casing, a pair of terminal plugs closing the ends of said casing, wherein the improvement comprises (a) a pair of straight co-planar grooves arranged in the planes of the axially inner end surfaces of said pair of terminal plugs;

(b) a pair of fusible elements connected in parallel and having their four ends in said pair of grooves, said pair of fusible elements being arranged out of registry in a direction longitudinally of said pair of grooves and the cross-sectional area of said pair of fusible elements varying periodically between a predetermined maximum value and a predetermined minimum value and including four axially outer co-planar portions and axially inner portions bent in opposite directions; and (c) two pairs of plates of electric insulating material exceeding in the length thereof the spacing of said four axially outer co-planar portions of said pair of fusible elements, each of said two pairs of plates sandwiching a pair of fusible elements at said axially outer co-planar portion thereof.

4. In an electric current-limiting fuse comprising a tubular casing of electric insulating material, a pulverulent arc-quenching filler inside said casing, a pair of terminal plugs closing said casing, wherein the improvement comprises (a) a pair of straight co-planar grooves in opposed end surfaces of said pair of terminal plugs;

(b) a pair of fusible elements immersed in said filler having their ends in said grooves and being displaced relative to each other in a direction longitudinally of said pair of grooves;

(c) each of said pair of elements having straight portions immediately adjacent said grooves and oppositely bent portions in the center regions thereof; and (d) a pair of insulating plates each sandwiching said straight portions of said pair of fusible elements.

* * * * *